United States Patent [19]

Martin

[11] 4,271,457

[45] Jun. 2, 1981

[54] INTERMITTENT LIGHT CIRCUIT BODY MOVEMENT ACTUATED JEWELRY

[76] Inventor: Danny W. Martin, 2704 Brookridge La., St. Charles, Mo. 63301

[21] Appl. No.: 22,196

[22] Filed: Mar. 20, 1979

[51] Int. Cl.[3] ..... F21L 15/08; A44C 7/00; H01H 35/02

[52] U.S. Cl. ..... 362/104; 63/13; 200/61.52; 362/806

[58] Field of Search ..... 362/104, 806-811, 362/195; 200/61.45 R, 61.52, 61.83; 63/12, 13

[56] References Cited

U.S. PATENT DOCUMENTS

| | | | |
|---|---|---|---|
| 3,383,503 | 5/1968 | Montgomery | 362/104 |
| 3,392,276 | 7/1968 | Roman | 362/104 |
| 3,689,758 | 9/1972 | Dower | 362/104 |

*Primary Examiner*—L. T. Hix
*Assistant Examiner*—Thomas H. Tarcza
*Attorney, Agent, or Firm*—Warren H. Kintzinger

[57] ABSTRACT

Ornamental articles of jewelry having a battery-light circuit extending through an articulating electrically conductive material interconnect link such as an ornamental multi-linked chain subject to intermittent circuit opening and closing with body movement.

8 Claims, 12 Drawing Figures

INTERMITTENT LIGHT CIRCUIT BODY MOVEMENT ACTUATED JEWELRY

Figure 1:
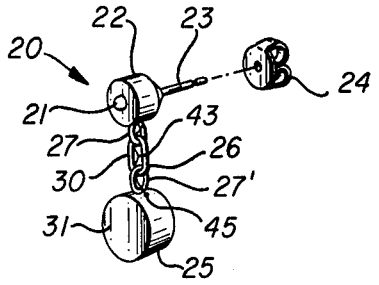

This invention relates in general to jewelry with lighting, and more particularly, to lighted jewelry such as body movement actuated intermittent lighting equipped jewelry with an artistic articulated multi-link interconnect a part of a battery-light cirtuit with intermittent light blinking caused by links of the multi-link circuit section and link end connections making and breaking contact.

There is some cross correlation between jewelry intermittent lighting of this application and my copending application Ser. No. 022,191 entitled "Intermittent Light Movement Jewelry Pendant" filed on the same date herewith. In consideration thereof in the designing of jewelry artistic endeavor has assumed many forms with lighting and light highlighting being an area of recent development such as with costumes and for on the stage devices. With the advent of low current low intensity lighting devices such as light emitting diodes the door to the use of lighting is opened for use of light in jewelry in the artistic sense with esthetically pleasing results in tastefully executed jewelry quite suitable for most any woman. Further, tastefully subdued jewelry lighting is made more intriguingly attractivewith intermittent body moement jiggled actuated momentary lighting as an accentuation indredient in jewelry.

It is, therefore, a principal object of this invention to provide light enhanced jewelry with light accentuation on an intermittently actuated basis.

Another object is to provide such light enhanced jewelry with a low current demand low intensity subdued intermittent lighting.

A further object is to provide such jewelry with batteries yielding reasonably long life in use.

Still another object is to provide intermittent lighted jewelry with lighting on an intermittent basis actuated by body movement.

Features of the invention useful in accomplishing the above objects include, intermittent light circuit body movement actuated jewelry, a battery-light circuit including an ornamental multi-linked chain section subject to intermittent circuit opening and closing with body movement of the person wearing the intermittently lighted jewelry. The lighted jewelry embodiments shown are earrings although they could assume other lighted jewelry item forms using substantially the same battery-light circuit with articulated multi-link circuit opening and closing for intermittent light actuation. The battery-light circuit includes a low current demand light emitting device such as a light emitting diode and a small battery or a plurality of small batteries as desired for voltage levels and/or extended operating life.

Specific embodiments representing what are presently regarded as the best modes of carrying out the invention are illustrated in the accompanying drawings.

Figure 4:
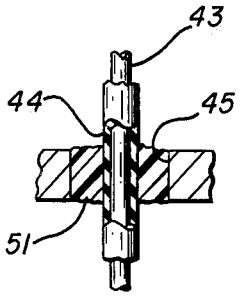
Figure 2:
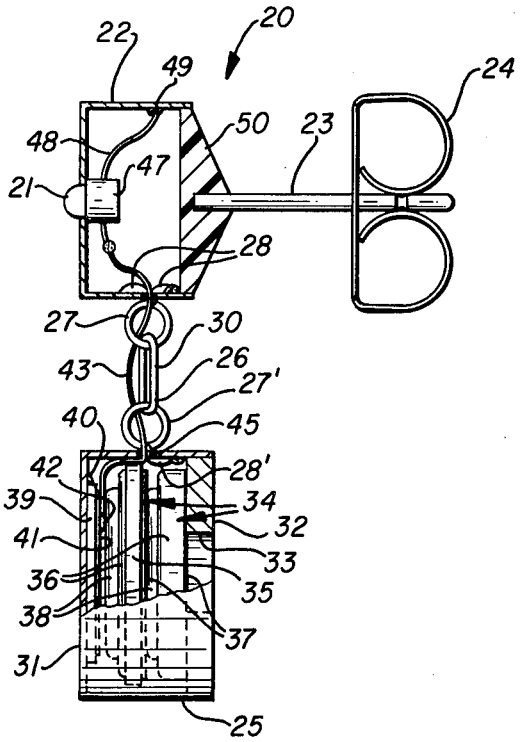
Figure 3:
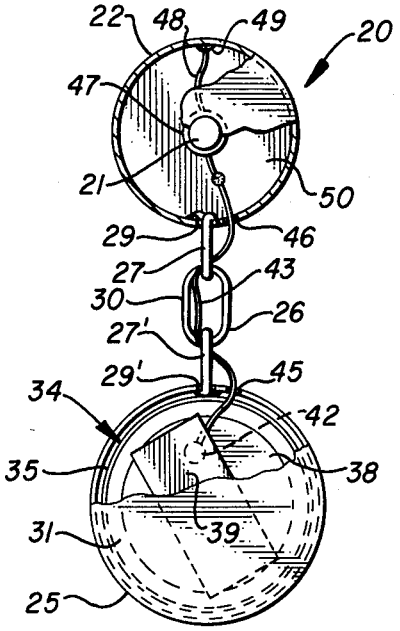
Figure 5:
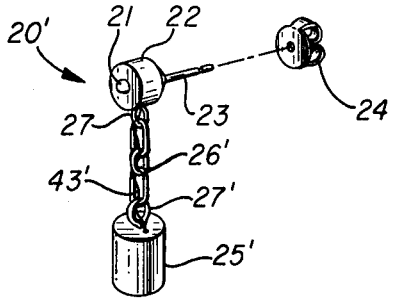
Figure 6:
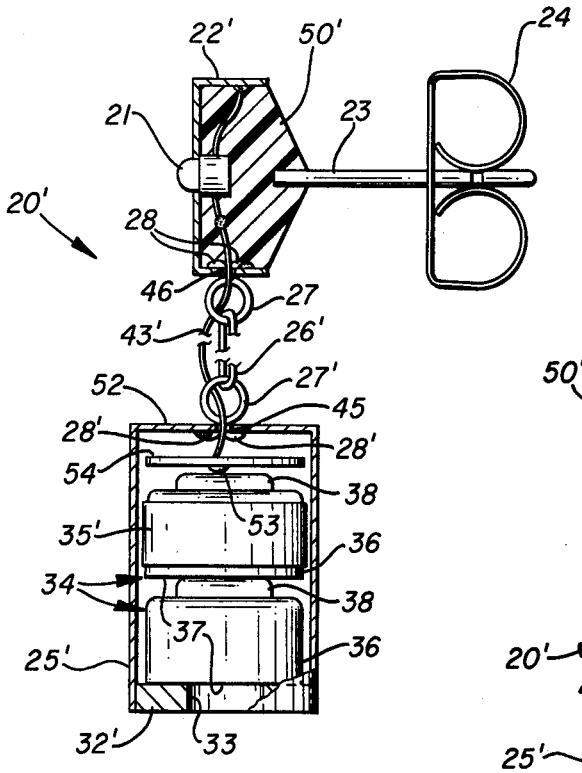
Figure 7:
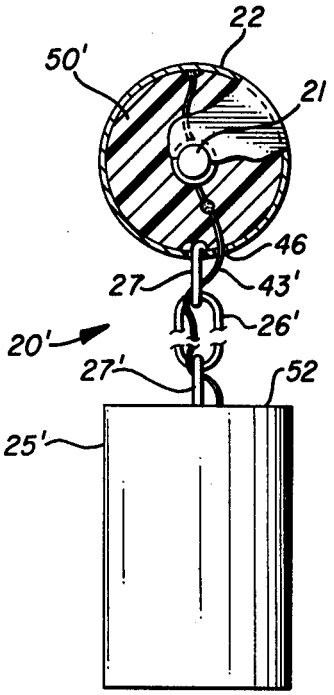
Figure 8:
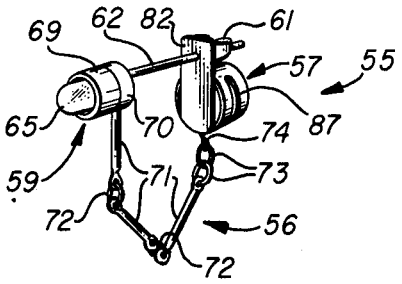
Figure 11:
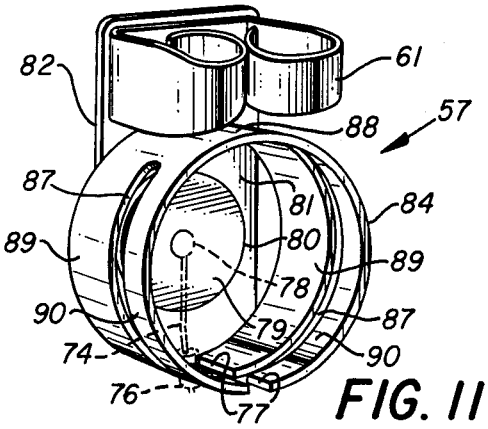
Figure 9:
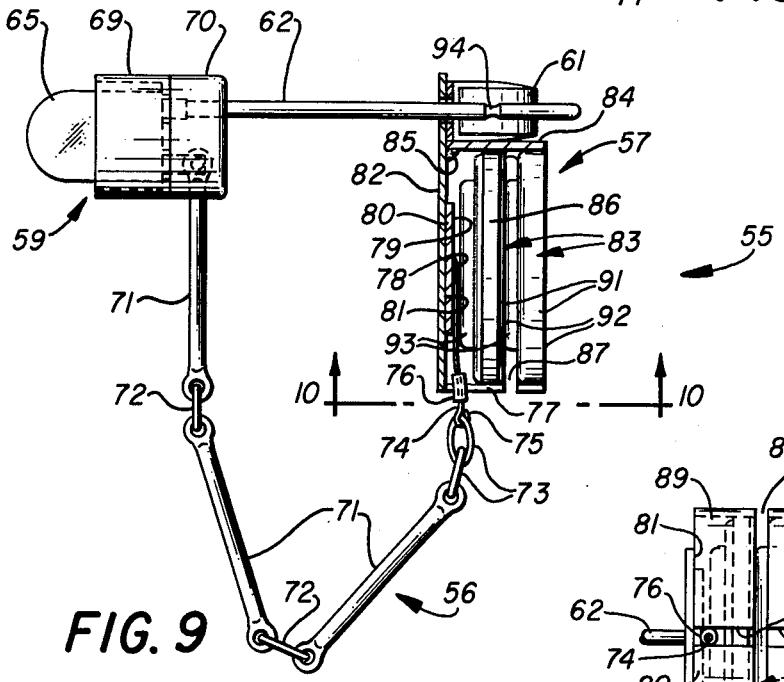
Figure 10:
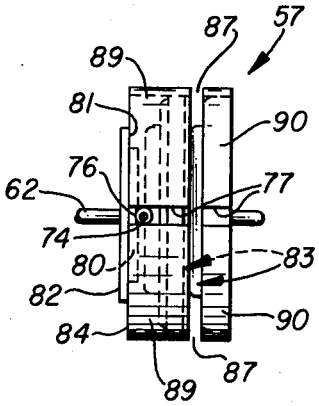
Figure 12:
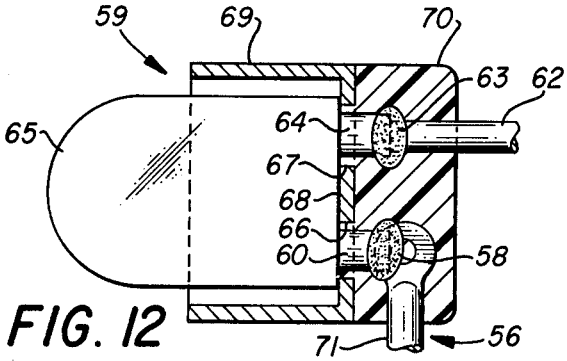

In the drawings:

FIG. 1 represents a perspective view of an earring equipped with an intermittently actuated light and having an ornamental chain suspended pendant that is esthetically ornamental yet functionally a battery carrier;

FIG. 2, a partially cut away and sectioned side elevation view of the earring and suspended pendant structure of FIG. 1;

FIG. 3, a partially cut away and sectioned front elevation view of the earring and suspended pendant structure of FIGS. 1 and 2;

FIG. 4, a partial sectioned view of the passage of varnish insulated conductive wire through an opening in the light equipped earring mount housing wall or in the pendant battery housing wall;

FIG. 5, a perspective view of an earring equipped with an intermittently actuated light and having an ornamental chain suspended pendant that is esthetically ornamental yet functionally a battery carrier;

FIG. 6, a partially cut away and sectioned side elevation view of the earring and suspended pendant structure of FIG. 5;

FIG. 7, a partially cut away and sectioned front elevation view of the earring and suspended pendant structure of FIGS. 5 and 6;

FIG. 8, a perspective view of an earring equipped with an intermittently actuated light and having a combination ornamental multi-link chain also functionally the battery-light circuit opening and closing circuit element;

FIG. 9, a partially cut away and sectioned side elevation view of the earring and suspended pendant structure of FIG. 8;

FIG. 10, a bottom view of the battery carrier taken from line 10—10 of FIG. 9;

FIG. 11, a perspective view of the combination earring clip and battery carrier with batteries removed; and, FIG. 12, an enlarged cut away and sectioned side elevation view of a light emitting diode mounting.

Referring to the drawings:

The intermittently lighted ornamental jewelry earring 20 of FIG. 1 is shown to have a light 21, preferably of the low current demand type such as a light emitting diode, mounted in a front housing 22 of conductive metal on the front end of mounting post 23 that extends through a pierced ear of the wearer with a clip 24 of a conventional nature holding it in place from the rear of the ear. Referring also to FIGS. 2 and 3, an electrically conductive metal cylindrical housing 25 is suspended as an ornamental jewelry pendant from earring front housing 22 by an interconnecting multi-link chain 26. Chain 26 has a top end link 27 having ends 28 inserted through opening 29 in earring front housing 22 and a bottom end link 27' having ends 28' inserted through opening 29' in housing 25 and an interconnecting link 30 that could be a plurality of links with all links being made of electrically conductive metal. The metal cylindrical pendant housing 25 has a front wall 31 and is closed by an electrically conductive aluminum (or other metal) plug 32 having a central opening 33 and encloses one or more batteries 34 such as the two seriesed batteries shown. With two batteries 34 seriesed as shown the higher battery 34 above the base battery must have its own outer circumference covered with an electrical insulation material band 35 to prevent shorting of the circuit through the base battery 34. The batteries used are such as hearing aid batteries of the small silver oxide 1.5 disc type batteries (Eveready No. S312E-6 being an illustrative example of such batteries commercially available on the market). With such batteries the cylindrical metal side 36 and bottom 37 is one terminal and a top projection 38 is the other terminal. A metal clad board 39 is epoxied 40 to the inner face of pendant front wall 31 with the conductive metal clad surface 41 facing and in contact with terminal 38 of the adjacent battery 34, particularly if the soldered connection 42 of clad surface 41 with lead wire 43 is not in direct contact with the adjacent battery terminal 38.

Lead wire 43 that is varnish coat 44 insulated wire extends from soldered connection 42 through opening 45 in housing 25, intertwining through links of chain 26, through opening 46 in earring front housing 22 to terminal connection with the light structure 47 mounting light 21 that is supported in housing 22. The other terminal connection of the light structure 47 is through wire 48 to a soldered connection 49 to the inner wall of front housing 22 that is closed at the rear by a nonconductive material plug 50 such as a dialectric plastic material plug that mounts the housing 22 on the front end of mounting post 23. It should be noted that instead of plug 50 the entire interior of housing 22 with components therein could be potted 50', as shown in FIG. 6 with the embodiment of FIG. 5, with a non-conductive epoxy material or other potting material also mounting the housing 22 or 22' on the forward end of mounting post 23. The varnish insulation coat 44 on lead wire 43 is protected in passage through respective housing openings 45 and 46 such as illustrated for opening 45 in FIG. 4 where epoxy insert 51 supports and protects the lead wire 43 in passage through the opening 45. Thus, interconnect multi-link ornamental chain 26 as part of the battery-light circuit of the earring 20 is subject to intermittent circuit opening and closing with body movement to thereby intermittently light the light 21 of the earring 20 in an esthetically pleasing intriguing manner.

With reference now to the earring 20' embodiment of FIGS. 5, 6 and 7, earring 20' has many features in common with the earring 20 of FIGS. 1–4 with in this instance suspended pendant housing 25' being a vertically top 52 mounted cylindrical pendant instead of being a side mounted cylindrical pendant housing 25 as with the embodiment of FIGS. 1–4. Earring 20' could employ a plug 50 as with the FIGS. 1–4 earring 20 embodiment or epoxy potting 50' as has been described. With the earring 20' embodiment much of the description is the same as with the earring 20 embodiment and not repeated in its entirety again even as to some of the primed numbered features. The bottom terminal soldered connection 53 of lead wire 43' is a battery 38 conductive contact weighted down and centered by insulation board disc 54 to insure conductive contact between the connection 53, which extends below the disc 54 and the terminal of the uppermost battery 34. Here again, the interconnect multi-link ornamental chain 26' as part of the battery-light circuit of the earring 20' is subject to intermittent circuit opening and closing with body movement to thereby intermittently light the light 21 of the earring 20' in an esthetically pleasing intriguing manner.

Referring now to the earring 55 embodiment of FIGS. 8–12 another intermittently actuated light equipped earring is shown that has an ornamental multi-link chain 56 and battery carrier 57 combination differing from their counterparts in the embodiments of FIGS. 1 and 5. With the earring 55 embodiment the ornamental multi-link chain 56 extends from a terminal soldered connection 58 with light structure 59 terminal 60 down under a pierced ear lobe of the wearer and back to the battery carrier 57 behind the ear. Battery carrier 57 is fastened to earring clip 61 that clips on earring post 62 that extends through the pierced ear lobe and provides a part of the battery-light circuit in connecting the conductive metal battery carrier through the post 62 to a connection 63 with light structure terminal 64. Light structure 59 that is on front ornamental part of the earring 55 mounts a light 65 preferably of the low current demand type such as a light emitting diode. The light 65 terminals 60 and 64 extend through openings 66 and 67, respectively, in the base 68 of the cup shaped ornamental light mount 69 with the openings 66 and 67 filled with insulation material such as epoxy. Further the post 62 to terminal 64 soldered connection 63 and the chain 56 to terminal 60 soldered connection 58 are encased in epoxy 70 that, thereby, also helps in holding light 65 in place in light mount 69.

The ornamental multi-link chain 56 is shown having electrically conductive links of various shapes long links 71 interconnected by small generally circular links 72, and larger looped type ring links 73 interconnect a long link 71 with a combination battery terminal connection hook 74. The hook 74 extends from external hook end 75 through a teflon insulation sleeve 76 and with the sleeve through slot 77 a battery carrier 57 to a soldered connection 78 at the inner end with the conductive metal clad face 79 of disc shaped clad board 80 fastened as by epoxy to the inner face 81 of the rear battery holder to clip 61 conductive metal interconnect plate 82. The battery 83 clasping portion 84 of battery carrier 57 is fastened by a solder connection 85 at the top to plate 82 but only at the top in order that the batteries 83 may be clasped. In order to facilitate clasping of a forward battery 83 with an insulation band 86 thereabout to prevent shorting of the circuit through the rear battery 83 the generally cylindrical clasping portion 84 is provided with a vertical slice 87 to a top unsliced portion 88 so that each side has a forward clasping arm 89 for the forward battery 83 and a rear clasping arm 90 extending down to slot 77. The batteries 83 used are such as hearing aid batteries with cylindrical metal side 91 and bottom 92 one terminal and a top projection 93 the other terminal. The two batteries 83 are individually clasped by clasping portion 84 clasping arms 89 and 90 in circuit series interconnected relation in the battery-light circuit that includes the electrically conductive metal ornamental multi-link chain 56 and a path through clip 61 that position resiliently clasps notch 94. Thus, interconnect multi-link ornamental chain 56 as part of the battery-light circuit of the earring 55 is subject to intermittent circuit opening and closing with body movement to thereby intermittently light the light 65 of the earring 55 in an esthetically pleasing intriguing manner.

Whereas this invention has been described with respect to several embodiments thereof, it should be realized that various changes may be made without departing from the essential contributions to the art made by the teachings hereof.

I claim:

1. In an article of jewelry having intermittent lighting for use as an earring worn in pierced ears: light means mounted on structure including an earring post; said earring post being electrically conductive and electrically connected to one terminal of said light means; electrically conductive earring clip member adapted to be removably affixed to the end of said earring post opposite said light means with said earring post extendable through a wearer's earlobe; said earring clip member comprising a battery carrier means; battery means mounted in said battery carrier means; said earring post with said clip member-battery carrier means affixed thereto providing electrical connection between one terminal of said battery means and said one terminal of said light means; and, circuit completing and breaking means of an articulating electrically conductive material interconnect linkage for electrically connecting the other terminal of said battery means and the other terminal of said light means and being subject to intermittent circuit opening and closing with body movements of said wearer producing intermittent actuation of said light means.

2. The article of jewelry of claim 1, with said earring clip member and said battery carrier means interconnected by an electrically conductive metal plate upon which said earring clip is mounted and to which said battery carrier means is at an upper location adjacent said earring clip member.

3. The article of jewelry of claim 1, wherein said battery means is a plurality of batteries of the relatively small flat type in electrically seriesed relation.

4. The article of jewelry of claim 2, wherein said battery carrier is a relatively small structure carried on said earring post behind the earlobe of the earring wearer; said battery carrier means mounting two of said relatively small flat type batteries in seriesed relation, two individual conductive metal battery clasping sections in said battery carrier grasping said two batteries in seriesed relation with the clasping section grasping the rear base battery, the first terminal connection for the circuit connection to said earring post; and the forward battery opposite terminal being said second terminal of said battery means.

5. The article of jewelry of claim 4, wherein said battery carrier is generally cylindrical in shape longitudinally slotted from end to end, and transversely sliced to one interconnecting portion to form said two clasping sections.

6. The article of jewelry of claim 1, wherein said light means is a low current demand light emitting diode.

7. The article of jewelry of claim 1, wherein said articulating electrically conductive linkage is a multi-linked ornamental chain making looping connection beneath said wearer's earlobe between said structure mounting said light means and said battery carrier means.

8. The article of jewelry of claim 2, wherein said articulating electrically conductive linkage is a multi-linked ornamental chain making looping connection beneath said wearer's earlobe between said structure mounting said light means and said battery carrier means.

* * * * *